United States Patent [19]

Start et al.

[11] 4,045,260

[45] Aug. 30, 1977

[54] EXPLOSIVE NITRAMINE SLURRY COMPOSITION

[75] Inventors: David Gordon Preston Start, Benoni; John Thomas Francis Fenwick, Phalaborwa, both of South Africa

[73] Assignee: AE & CI Limited, Johannesburg, Transvaal, South Africa

[21] Appl. No.: 597,838

[22] Filed: July 21, 1975 (Under 37 CFR 1.47)

[30] Foreign Application Priority Data

| | | |
|---|---|---|
| July 19, 1974 | South Africa | 74/4617 |
| July 19, 1974 | South Africa | 74/4618 |
| July 19, 1974 | South Africa | 74/4619 |

[51] Int. Cl.[2] ..... C06B 45/00

[52] U.S. Cl. ..... 149/2; 149/38; 149/44; 149/92

[58] Field of Search ..... 149/92, 38, 44, 2

[56] References Cited

U.S. PATENT DOCUMENTS

| | | | |
|---|---|---|---|
| 3,617,404 | 11/1971 | Lyerly | 149/92 X |
| 3,629,021 | 12/1971 | Lyerly | 149/92 X |
| 3,674,578 | 7/1972 | Cattermole et al. | 149/92 X |

*Primary Examiner*—Stephen J. Lechert, Jr.
*Attorney, Agent, or Firm*—Cushman, Darby & Cushman

[57] ABSTRACT

Slurry explosive compositions containing, as a sensitizing component, an effective amount of a water-soluble nitramine, for example methylnitramine. The nitramine may be in the form of a salt.

15 Claims, No Drawings

EXPLOSIVE NITRAMINE SLURRY COMPOSITION

The present invention relates to an improved explosive composition. More particularly, it relates to explosive compositions of the water bearing type generally known in the art as slurry explosive compositions or slurry explosives or slurried blasting agents which comprise an oxidizing salt a fuel and a liquid solvent, disperser or carrier for said salt. Although the term 'slurry' is universally applied to such compositions, the degree of consistency may range from pourable to highly viscous extrudable gels. The oxidising salt generally comprises intrates or perchlorates of ammonia, sodium, potassium, calcium or barium and mixtures of any two or more of said nitrates. In the most extensively used compositions the oxidising salt is ammonium nitrate alone or in admixture with sodium nitrate.

In slurry explosive compositions the liquid content is sufficient to maintain a reasonably continuous liquid phase, which renders the compositions fluid or plastic for direct loading into boreholes or for packaging in paper or synthetic plastics wrapped cartridges. As is known, the liquid phase can be constituted in various ways. Thus, it may consist mainly of an aqueous solution of oxidising salt but in some known compositions it comprises an emulsion of water in oil or it may be a dispersion of oil in droplet form throughout a thickened aqueous phase. Non-aqueous slurry explosive compositions are also known wherein a liquid chemical compound provides the liquid phase.

Thickening agents have been employed extensively to increase the viscosity of explosive slurry compositions to the desired degree to prevent segregation of the ingredients and to improve their resistance to deterioration in wet conditions. These agents include various flours or powders of natural polysaccharides (of which guar gum has been the most popular) and biopolymers such as Xanthan gums. Further improvement in homogeneity and storage properties of the slurry compositions has been achieved by chemically crosslinking the thickening agents with crosslinking agents such as potassium and sodium dichromates or potassium pyroantimonates which are compatible with the other components of the explosive slurry compositions.

It is also common practice in the art to aerate explosive slurry compositions in order to improve their sensitivity to initiation by the well known 'hot spot' technique. Aeration may be effected by mechanical mixing alone but is generally enhanced by the inclusion of foaming surfactant in the composition. Other methods are the inclusion of gas filled spheres of glass or synthetic plastics material or gas generating compounds in the compositions.

The fuel component is provided in the explosive slurry composition for oxygen balance and it also enhances the power and sensitises the composition. The range of fuels is large. Thus, for compositions for use with heavy priming in large diameter, coal, carbon black, sulphur, sugar, aluminium, molasses, starches and various alcohols have been found suitable.

Sensitising components are included in explosive slurry compositions to enhance their sensitivity to initiation. In order to provide more sensitive compositions requiring less powerful and, therefore, less expensive boosters to initiate them, more effective sensitising components (which may also be fuels) are included. Well known sensitisers proposed or used in this respect have been trinitrotoluene, nitrobenzene, nitric acid, cellulose nitrate, aluminium, magnesium and boron. Such sensitisers have disadvantages in that they are solid or liquid water-insoluble materials and are difficult to dispers uniformly and hold in suspension in the slurries. In the case of the liquid water-insoluble sensitisers, syneresis is liable to occur in the explosives slurry compositions as finally prepared. Frequently, the sensitisers have an objectionable odour or marked physiological properties. Solid sensitisers of light, finely divided elements are difficult to incorporate in a homogeneous manner and explosive slurry compositions containing such components are liable to desensitisation during packaging operations and while kept in storage.

The important concept of this invention is the development of new sensitising components for slurry explosive compositions and it is the principal object of the invention to provide slurry explosive compositions with more satisfactory sensitising components in order to minimise or eliminate those disadvantages encountered in the prior art.

Accordingly, this invention provides explosive slurry compositions which include as a sensitising component an effective amount of at least one nitramine soluble in the continuous phase of the composition, a nitramine salt or a mixture of said nitramine and nitramine salt.

Preferably the composition contains 5 to 30% w/w, and more preferably 10 to 30% w/w of the nitramine sensitising component.

The sensitising components of this invention are compatible with other ways and means of explosive slurry sensitisation, such as chemical or mechanical gassing to give density modifications, the use of light elemental sensitisers or other sensitisers. Thus, there may advantageously be included in the composition a foaming surfactant to entrap air during stirring, or chemical gassing agents such as sodium nitrite or thiourea to generate gas in situ or hollow microballoons.

Advantageously, the sensitising component comprises (a) a primary nitramine of the formula R—N-H—$NO_2$ wherein R represents a methyl, ethyl, propyl, isopropyl, butyl, isobutyl or tertbutyl group or (b) a secondary nitramine of the formula

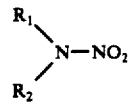

wherein $R_1$ represents a methyl and $R_2$ represents methyl, ethyl, propyl or isopropyl group, or $R_1$ and $R_2$ are ethyl groups or (c) a primary dinitramine group of the formula

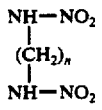

wherein $n$ is 1, 2, 3 or 4, or (d) a salt of any of said nitramines or dinitramines.

Thus, the sensitising component may conveniently comprise a salt of a primary nitramine or a mixture of a primary nitramine salt with primary and/or a secondary nitramine.

The preferred sensitising component comprises methyl nitramine or a salt thereof or a mixture of methylnitramine and a salt thereof. Methylnitramine (hereinafter termed MENA) forms clear, needle-shaped crystals, melting at 38° C which start to decompose about 160° C. It is an especially effective sensitiser because it has an explosive group (—$NHNO_2$) which is resistant to hydrolysis in solution. It is very soluble in water and it is oxygen negative. Slurries sensitised with MENA or its salts can be readily initiated unconfined in 25 mm diameter cartridges.

Solutions of MENA are acidic which is further advantageous in accelerating the crosslinking of thickeners and the reaction of chemical aeration agents.

Preferred slurry explosive compositions of the invention comprise 50 to 80% w/w of at least one inorganic oxidising salt, 5 to 30% w/w of water, 10 to 30% w/w of MENA and up to 25% w/w of other fuel. Convenient fuel materials include aluminium powder, urea and ethylene glycol. For most general purposes the slurry is advantageously thickened with 0.2 to 2% w/w of thickener, such as guar gum or Xanthan gum, which may be crosslinked with about 0.01 to 0.1% w/w of a crosslinking agent such as, for example, potassium pyroantimonate, zinc chromate or dichromate of sodium or potassium.

The invention is further illustrated by the following Examples in which all parts and percentages are by weight. Examples 2, 3 and 9 are not in accordance with the invention but are included for comparison.

In the preparation of the Examples the oxidising salt, MENA, guar gum, any solid fuel and crosslinking agent were thoroughly mixed and water and any liquid fuel were then added mixed. Finally the aeration agent was mixed with the composition. In Examples 1 to 8, in which the aeration agent was a surfactant, the composition was stirred until the desired density was obtained.

Details of the composition and properties of the Examples are given in the accompanying Table. The relative sensitivity of the composition is indicated by the weakest charge of a series of test initiating charges required to initiate unconfined 2.5 cm diameter cartridges at ambient temperature. The test charges in ascending order of strength were initiators with the following base charges:

| | wt. PETN in base charge |
|---|---|
| ½ 6D | 0.15 gm. |
| 6D | 0.35 gm. |
| 8D | 0.78 gm. |
| 6D + 'Anstart' pellet | 1.7 gm. |

The power was measured by the ballistic mortar method.

TABLE

| Example | 1 | 2 | 3 | 4 | 5 | 6 | |
|---|---|---|---|---|---|---|---|
| Composition (Parts) | | | | | | | |
| MENA | 15.00 | Nil | Nil | 20.00 | 10.00 | 15.00 | |
| Ammonium nitrate | 51.50 | 51.50 | 58.00 | 49.60 | 58.50 | 70.00 | |
| Sodium nitrate | 15.00 | 15.00 | 15.00 | 15.00 | 10.00 | — | |
| Water | 6.00 | 6.00 | 5.00 | 6.00 | 8.00 | 7.00 | |
| Urea | 11.50 | 11.50 | 20.00 | 8.00 | 7.00 | — | |
| Atomised Aluminium (a) | — | — | — | — | 5.00 | 5.00 | |
| Ethylene glycol | — | — | — | — | — | — | |
| Guar gum | 0.50 | 0.50 | 0.50 | 0.50 | 0.50 | 0.50 | |
| Potassium pyroantimonate | 0.02 | 0.02 | 0.02 | — | 0.02 | 0.02 | |
| Zinc chromate | — | — | — | 0.05 | — | — | |
| Sodium dichromate | — | — | — | — | — | — | |
| Surfactant (b) | 0.65 | 0.65 | 0.65 | 0.65 | 0.65 | 0.65 | |
| Glass microballoons (Δ = 0.3 g/cc) | — | — | — | — | — | — | |
| Properties | | | | | | | |
| Density | 1.10 | 1.03 | 1.05 | 1.10 | 1.15 | 1.05 | 1.15 |
| Minimum initiator | 8D | Fail | Fail | 8D | 6D | ½6D | 6D |
| Velocity of detonation (Km/sec) | 3.46 | — | — | 3.18 | — | 3.31 | 3.79 |
| Power (% blasting gelatine) | — | — | — | — | — | — | — |

| Example | 7 | 8 | 9 | 10 | 11 |
|---|---|---|---|---|---|
| Composition (Parts) | | | | | |
| MENA | 20.60 | Nil | 15.00 | 20.00 | 27.07 |
| Ammonium nitrate | 57.00 | 58.00 | 64.87 | 62.37 | 60.30 |
| Sodium nitrate | 10.00 | 15.00 | — | — | — |
| Water | 6.00 | 7.00 | 12.00 | 12.00 | 12.00 |
| Urea | — | 13.00 | — | — | — |
| Atomised Aluminium (a) | 5.00 | 5.00 | — | — | — |
| Ethylene glycol | — | — | 5.00 | 2.70 | — |
| Guar gum | 0.50 | 0.50 | 0.60 | 0.50 | 0.60 |
| Potassium pyroantimonate | 0.02 | 0.02 | 0.03 | 0.03 | — |
| Zinc chromate | — | — | — | — | — |
| Sodium dichromate | — | — | — | — | 0.03 |
| Surfactant (b) | 0.60 | 0.65 | — | — | — |
| Glass microballoons (Δ = 0.3 g/cc) | — | — | 2.50 | 2.50 | — |
| Properties | | | | | |
| Density | 1.30 | 1.04 | 1.30 | 1.30 | 1.41 |
| Minimum initiator | 6D | Fail | 6D | 6D | 6D |
| Velocity of detonation (Km/sec) | — | — | — | — | — |
| Power (% blasting gelatine) | — | — | 74.00 | — | 78.00 |

(a) at least 95% passing 250 μ (BS60) mesh sieve; at least 60% passing 125 μ (BS120) mesh sieve; at least 25% passing 63 μ(BS240) mesh sieve.

(b) Paste containing 6.4 parts of commercial ethoxylated ammonium lauryl sulphate (60% active ingredient) and 1 part of 50/50 w/w mixture of arachidyl and behenyl amines.

The results show that compositions containing MENA were much more sensitive than corresponding compositions from which this ingredient was omitted. Thus, Example 1 was more sensitive than Example 2, the same composition without MENA, and also Example 3 which was similar to Example 2 but adjusted to restore the oxygen balance. Likewise, Example 7 was more sensitive than Example 8, which was a similar composition containing urea but no MENA. The inclusion of atomised aluminium in Examples 5 to 8 increased the sensitivity and lowering the density by use of surfactant or glass microballoons also noticeably increased the sensitivity.

MENA was the sole sensitiser in Example 11 and it was effective to give sensitive explosive of high density.

MENA was found to be advantageous in its safety in handling and processing and in the ease with which it could be dispersed throughout the composition. It had no noticeable physiological hazards and there was no desensitisation of the compositions after processing and during storage.

What we claim is:

1. An explosive slurry composition comprising a continuous phase and at least one nitramine sensitising component which is selected from the group consisting of a. a primary nitramine of the formula $R—NH—NO_2$ wherein R represents a methyl, ethyl, propyl, isopropyl, butyl, isobutyl or tertbutyl group;

b. a secondary nitramine of the formula

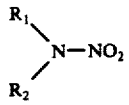

wherein $R_1$ represents a methyl and $R_2$ represents methyl, ethyl, propyl or isopropyl group, or $R_1$ and $R_2$ are ethyl groups;

c. a primary dinitramine group of the formula

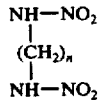

wherein *n* is 1, 2, 3 or 4; and d. a salt of any of said nitramines or dinitramines wherein said composition contains 10–30% w/w of the nitramine sensitizing component.

2. A composition as claimed in claim 1 comprising 10 to 30% w/w of the sensitising component.

3. A composition as claimed in claim 1 wherein the sensitising component comprises methylnitramine or a salt thereof or a mixture of methylnitramine and a salt thereof.

4. A composition as claimed in claim 3 comprising 50 to 80% w/w of at least one inorganic oxidising salt, 5 to 30% w/w of water, 10 to 30% w/w of methylnitramine and up to 25% w/w of fuel other than methylnitramine.

5. A composition as claimed in claim 1 comprising aluminium powder, urea or ethylene glycol.

6. A composition as claimed in claim 1 comprising 0.2 to 2% w/w of a thickener.

7. A composition as claimed in claim 6 wherein the thickener comprises guar gum of Xanthan gum.

8. A composition as claimed in claim 6 comprising 0.01 to 0.1% w/w of a crosslinking agent for the thickener.

9. A composition as claimed in claim 8 wherein the crosslinking agent comprises potassium pyroantimonate, zinc chromate, sodium dichromate or potassium dichromate.

10. A composition as claimed in claim 1 comprising an aeration agent.

11. A composition as claimed in claim 10 comprising 0.1 to 1% of a foaming surfactant.

12. A composition as claimed in claim 10 comprising 0.5 to 5% of glass microballoons.

13. A composition as claimed in claim 1 comprising 50 to 80% w/w of at least one inorganic oxidising salt, 5 to 30% w/w of water, 10 to 30% w/w of methylnitramine and up to 25% w/w of fuel other than methylnitramine.

14. A composition as claimed in claim 13 which includes aluminum powder, urea or ethylene glycol.

15. A composition as claimed in claim 13 comprising 0.2 to 2% w/w of a thickener.

* * * * *